US005867077A

United States Patent [19]

Lundquist

[11] Patent Number: 5,867,077

[45] Date of Patent: Feb. 2, 1999

[54] TEMPERATURE COMPENSATED MICROWAVE FILTER

[75] Inventor: Steven Barton Lundquist, Cambridge, Canada

[73] Assignee: Com Dev Ltd., Cambridge, Canada

[21] Appl. No.: 815,223

[22] Filed: Mar. 12, 1997

[30] Foreign Application Priority Data

Oct. 15, 1996 [CA] Canada ..... 2187829

[51] Int. Cl.[6] ..... H01P 1/208; H01P 1/30

[52] U.S. Cl. ..... 333/208; 333/229

[58] Field of Search ..... 333/208, 212, 333/227–230

[56] References Cited

U.S. PATENT DOCUMENTS

| | | | |
|---|---|---|---|
| 2,507,426 | 5/1950 | Turney | 333/229 |
| 3,697,898 | 10/1972 | Blachier et al. | 333/21 A |
| 4,260,967 | 4/1981 | Flieger | 333/229 X |
| 4,513,264 | 4/1985 | Dorey et al. | 333/209 X |
| 4,792,771 | 12/1988 | Siu | 333/208 |
| 5,309,129 | 5/1994 | Arnold et al. | 333/229 |
| 5,374,911 | 12/1994 | Kich et al. | 333/229 X |

*Primary Examiner*—Seungsook Ham
*Attorney, Agent, or Firm*—Daryl W. Schnurr

[57] ABSTRACT

A temperature compensated microwave filter has end caps and irises that each contain a projection that extends into a cavity to reduce the volume change of the cavity that would otherwise occur with changes in temperature due to an expansion or contraction of the side walls. The end caps and irises are formed from a single material. The material has a more positive coefficient of thermal expansion than the coefficient of thermal expansion of the side walls of each cavity. While one material is used to make up each end cap or iris, it is not necessary that the same material be used for all of the end cap and iris components.

17 Claims, 8 Drawing Sheets

TEMPERATURE COMPENSATED MICROWAVE FILTER

BACKGROUND OF THE INVENTION

1. Field of the Invention

This invention relates to microwave filters having at least one cavity with one or more end walls that are shaped to compensate for changes in temperature and to a method of construction thereof.

2. Description of the Prior Art

It is known to have temperature compensated filters. Previous filters have bimetal end caps that bend into a cavity of the filter with increases in temperature. The Collins, et al. U.S. Pat. No. 4,488,132 issued Dec. 11th, 1984 describes a resonant microwave cavity with a bimetal end cap or a trimetal end cap. In some previous filters, the end cap is made of two or more materials with different coefficients of thermal expansion, one of which is not metal. Even when one of the materials is not metal, the structure is referred to as being bimetal. The Atia, et al. U.S. Pat. No. 4,156,860 issued May 29th, 1979 describes a filter having a tuning plunger assembly where the assembly is formed by potting compounds such as a pourable silicon resin, which has properties of high thermal expansion. The Kick U.S. Pat. No. 4,677,403, issued Jun. 30th, 1987, describes a temperature compensated microwave resonator where a temperature compensating structure is bimetallic and there is a material having a higher temperature coefficient than the material forming the waveguide body that is affixed to the end wall by solder or by being bolted thereto. In addition, the temperature compensating structure includes means for varying the effective diameter of a tuning screw.

Bimetallic structures are much more expensive to manufacture than the end walls and irises of the present application. Further, whether the temperature compensating structure is a material having a high temperature coefficient that is bimetallic or is affixed to an end wall, it is extremely difficult to design the filter so that the temperature compensating structure works accurately. Further, bimetal end caps or irises have a much smaller temperature range over which they can successfully be made to operate when compared to the end caps and irises of the present invention.

SUMMARY OF THE INVENTION

A microwave filter has at least one cavity resonating at its resonant frequency in at least one mode. The at least one cavity has a side wall and two end walls. The coefficient of thermal expansion of the material from which said at least one end wall is made is more positive than the coefficient of thermal expansion of a material from which the side wall is made. The at least one end wall is shaped to reduce a change in volume of said cavity that would otherwise occur with temperature from a change in size of said side wall. The at least one end wall is made from a non-bimetal material. The filter has an input and an output operatively connected thereto.

DESCRIPTION OF A PREFERRED EMBODIMENT

Figure 1:
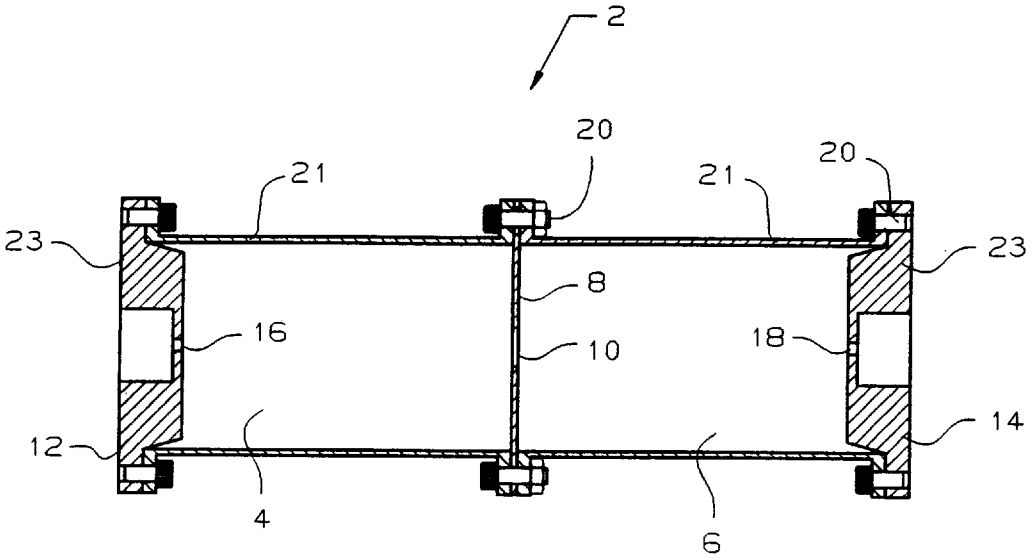
FIG. 1 is a sectional side view of a two cavity filter.

Referring to the drawings in greater detail, in FIG. 1, a filter 2 has two waveguide cavities 4, 6 separated by an iris 8 containing an aperture 10. The iris 8 provides an end wall for each cavity 4, 6. Each cavity 4, 6 also has another end wall in the form of an end cap 12, 14. The end cap 12 contains a coupling slot 16, which provides a filter input and the end cap 14 contains a coupling slot 18, which provides a filter output. As can be seen, the cavities, irises and end caps are held together by bolts 20. Various other fastening means are suitable.

Cavities 4, 6 have side walls 21. End caps 12, 14 are made of a material that has a more positive coefficient of thermal expansion than the material of the side walls 21. The end caps 12, 14 have a U-shaped cross-section with a base of the U protruding into the cavity with which the end cap is used. The end caps 12, 14 are usually identical to one another. However, slight dimensional differences may be required in the length of the projection in the form of a projection 23. As temperature increases, the side walls 21 will increase in length and cross-section, thereby, if not otherwise compensated, causing a volume of each cavity 4, 6 to increase. As volume increases, a resonant frequency of the cavity decreases. As temperature increases, the end caps 12, 14 will increase in size and a projection 23 of each of said end caps extending into each cavity will further extend into each cavity 4, 6 thereby reducing or substantially compensating for the increase in volume and decrease in resonant frequency of each cavity caused by the increase in size of the side walls 21. In other words, the material of the end caps 12, 14 can be chosen to have a more positive coefficient of thermal expansion than the material of the side walls 21. Also, the projections 23 on each of the end caps 12 can be sized to cause the volume of the cavity to remain substantially constant as temperature increases by substantially compensating for what would otherwise be the increase in volume and decrease in resonant frequency of the cavity caused by the increase in size of the side walls 21. A greater reduction in volume of each cavity can result from a larger projection (with a greater depth along a longitudinal axis of the cavity) than from a smaller projection (with a lesser depth along said longitudinal. axis). The iris 8 is flat and has no appreciable effect on the volume of either of the cavities 4, 6 as temperature increases or decreases.

Figure 2:
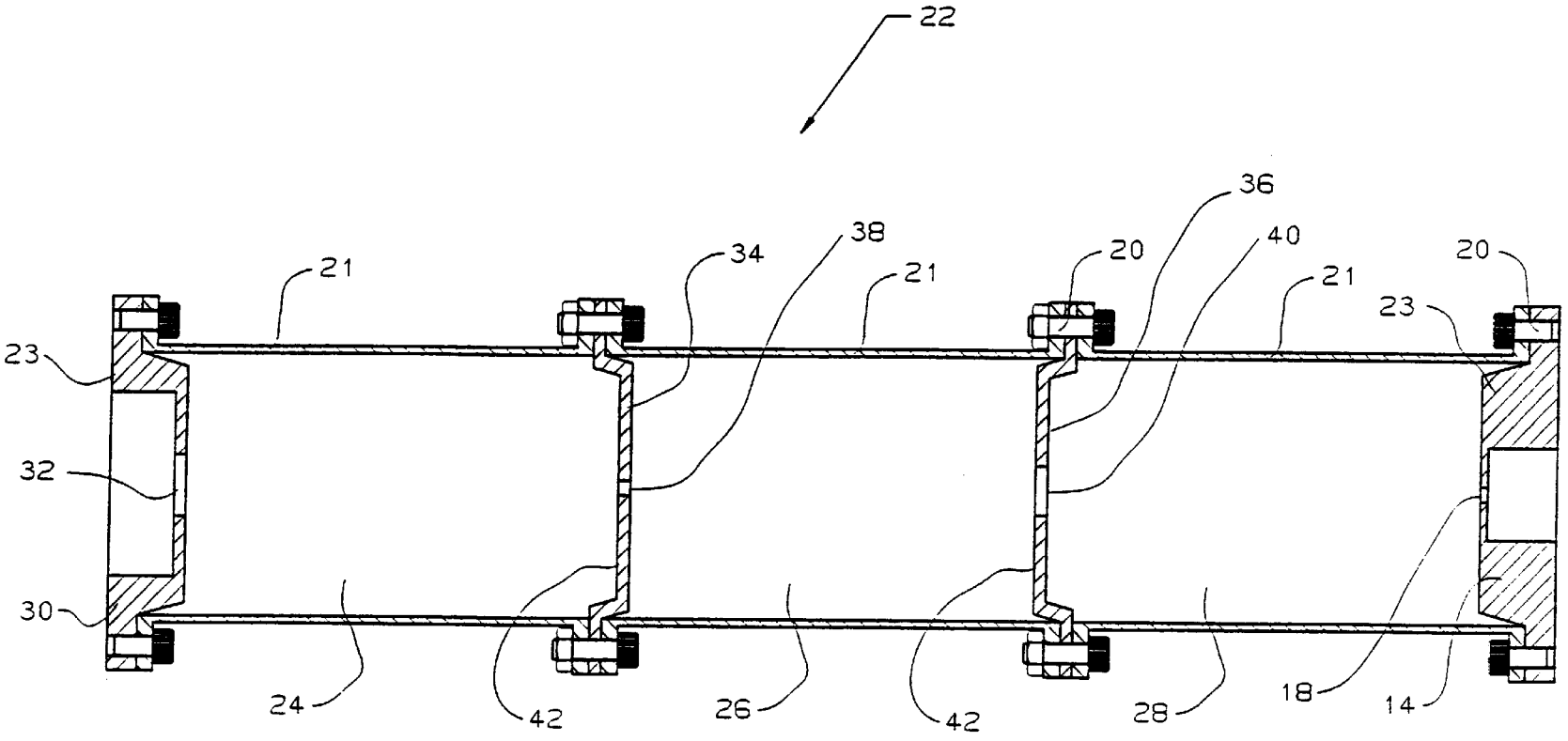
FIG. 2 is a sectional side view of a three cavity filter.

In FIG. 2, there is shown a filter 22 having three cavities 24, 26, 28. The same reference numerals are used in FIG. 2 for those components that are the same as those of FIG. 1. The filter 22 has two end caps 14, 30. The end cap 30 has a larger input 32 than the end cap 12 of FIG. 1. Irises 34, 36 have apertures 38, 40 therein. The aperture 40 is larger than the aperture 38. The end caps, irises and cavities are held together by bolts 20.

It can be seen that the irises 34, 36 have a U-shaped cross-section similar to that of the end caps 14, 30. The iris 34 has a horizontal slot as an aperture 38 and the iris 36 has a vertical slot 40. The actual shape of the apertures in the irises will vary depending on the number of modes and the desired response. While the iris 8 of FIG. 1 is flat, the irises 34, 36 of FIG. 2 have a projection 42 thereon extending into the cavity 26.

In operation of the filter 22, when temperature increases the side walls 21 of the cavities 24, 26, 28 will increase in size. Simultaneously, the projection 23 of the end cap 14 will extend further into the cavity 28 and the projection 23 of the end cap 30 will extend further into the cavity 24. The projections 42 of the irises 34, 36 will extend further into the cavity 26 with an increase in temperature. However, as the projections 42 extend further into the cavity 26, these projections will simultaneously be extending further away from the end caps 30, 14 respectively to increase the volume of cavities 24, 28. The depth of the projections 42 is smaller (approximately one-half) than the depth of the projections 23. If the irises 34, 36 are made from the same material as the end caps 14, 30, the projections 23 will move approximately twice as far into the cavities 24 and 28 than the projections 42 will move into the cavity 26. However, for the cavity 26, projections 42 are moving into the cavity 26 to compensate for the increase in volume of that cavity from each end of the cavity. With cavities 24, 28, as the projections 23 are moving further into these cavities 24, 28, the projections 42 are moving further out of these cavities 24, 28. For greater versatility, depending on the design requirements, the irises 34, 36 could be made from a material having a different coefficient of thermal expansion than the end caps 14, 30.

Figure 3:
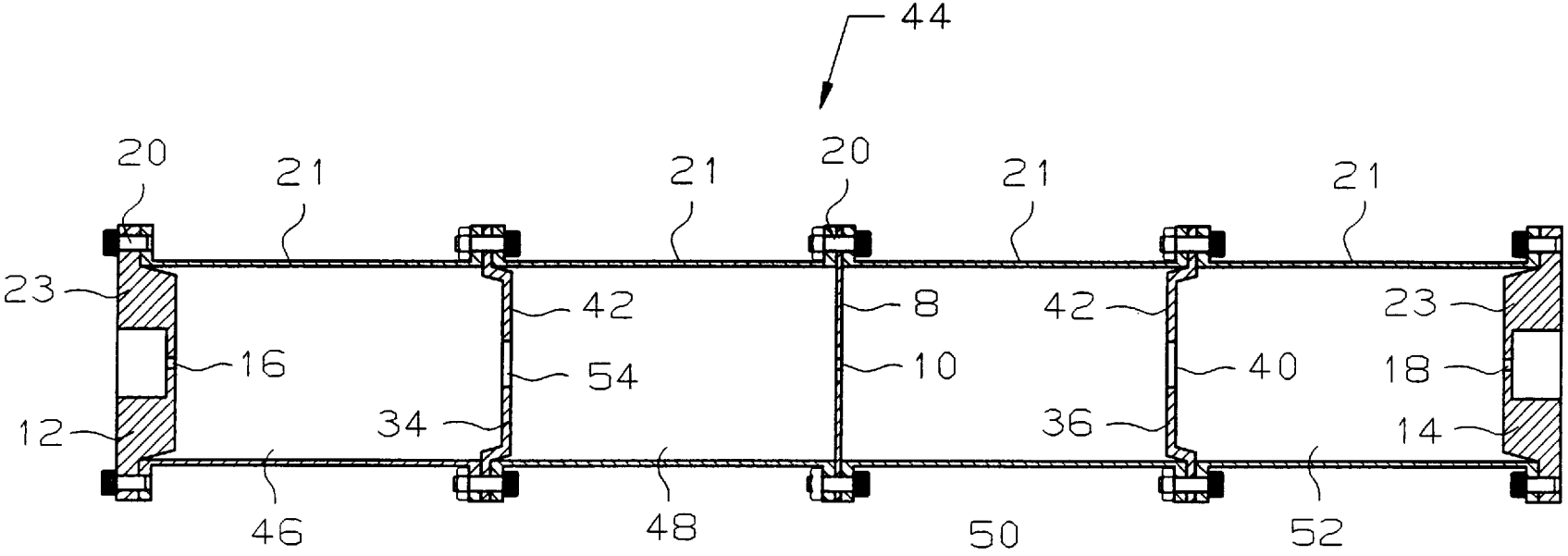
FIG. 3 is a sectional side view of a four cavity filter.

In FIG. 3, a filter 44 has four cavities 46, 48, 50, 52. Those components of FIG. 3 that are the same as the components of FIGS. 1 and 2 will be described using the same reference numerals. It can be seen that the iris 34 has a different aperture 54 than the iris 34 of FIG. 2. One aperture can be a horizontal slot and one can be a vertical slot. The iris 8 located between cavities 48, 50 is the same as the iris 8 and aperture 10 of FIG. 1. The iris 36 with the projection 42 and aperture 40 is the same as the iris 36 and aperture 40 of FIG. 2.

In operation, as temperature increases, the increase in the volume of the cavity 46 is at least partially compensated by the increase in a movement of the projection 23 into the cavity 46. Simultaneously with the movement of the projection 23 further into the cavity 46, the projection 42 of the iris 34 moves further out of the cavity 46 and further into the cavity 48, to compensate for an increase in volume of that cavity. Cavity 50 operates in a similar manner in relation to temperature compensation as cavity 48 and cavity 52 operates in a similar manner in relation to temperature compensation as cavity 46.

Figure 4:
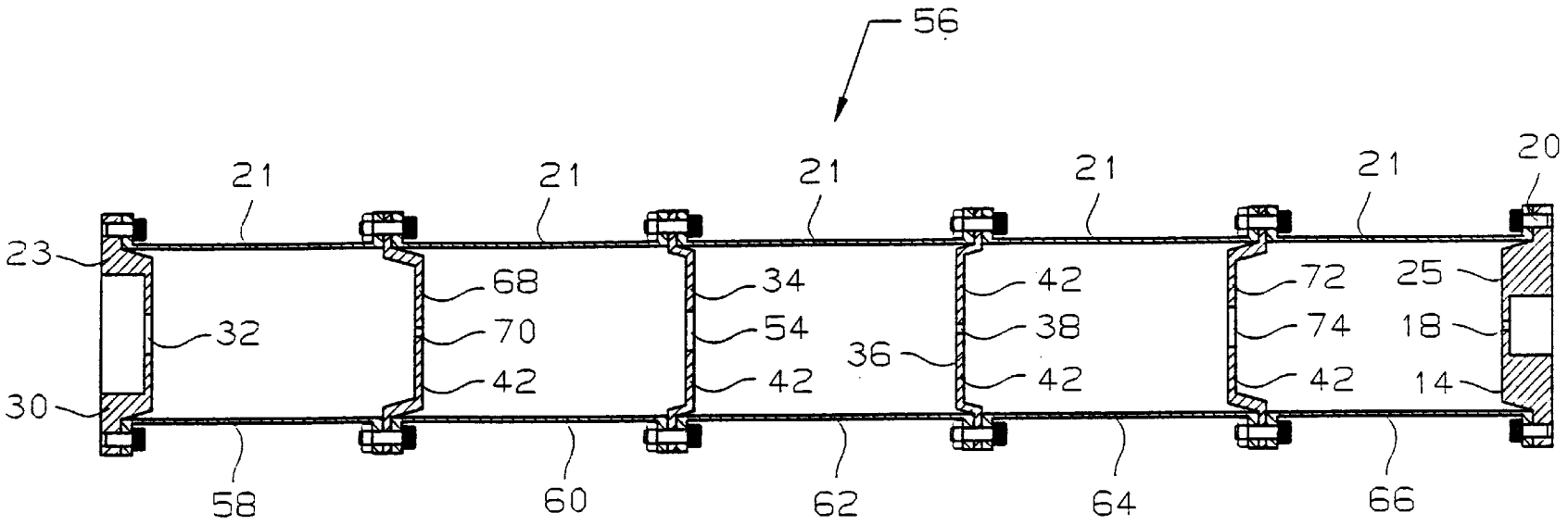
FIG. 4 is a sectional side view of a five cavity filter.

In FIG. 4, a filter 56 has five cavities 58, 60, 62, 64, 66. Those components of the filter 56 of FIG. 4 that are the same as components in any of the previous figures are described using the same reference numerals as used in those figures. An iris 68 is located between cavities 58, 60 and has an aperture 70 and projection 42. An iris 72 is located between cavities 64, 66 and has an aperture 74 and projection 42.

In operation of the filter 56, it can been seen that the irises 34, 36 have a smaller projection 42 than the projection 42 of the irises 68, 72, which, in turn, are smaller than the projections 23 on the end caps 30, 14. As temperature increases, the projections 23 on the end caps 30, 14 will project into cavities 58, 66 respectively by a greater distance than the projections 42 of the irises 68, 72 will extend out of the cavities 58, 66 and into the cavities 60, 64. The projections 42 of the irises 68, 72 will extend into the cavities 60, 64 respectively by a greater distance than the projections 42 of the irises 34, 36 will extend out of the cavities 60, 64 and into the cavity 62. The irises and the end caps can be made of the same material or can be made of different materials having different coefficients of thermal expansion depending on the overall compensation required in each cavity. It can be seen that, as temperature increases, the various projections of the end caps and the irises will reduce and/or will substantially eliminate the increase in volume caused by the expansion of the cavity walls 21. In some filter designs, it may be desirable to overcompensate one or more cavities so that the one or more cavities decrease in volume as temperature increases.

Figure 6:
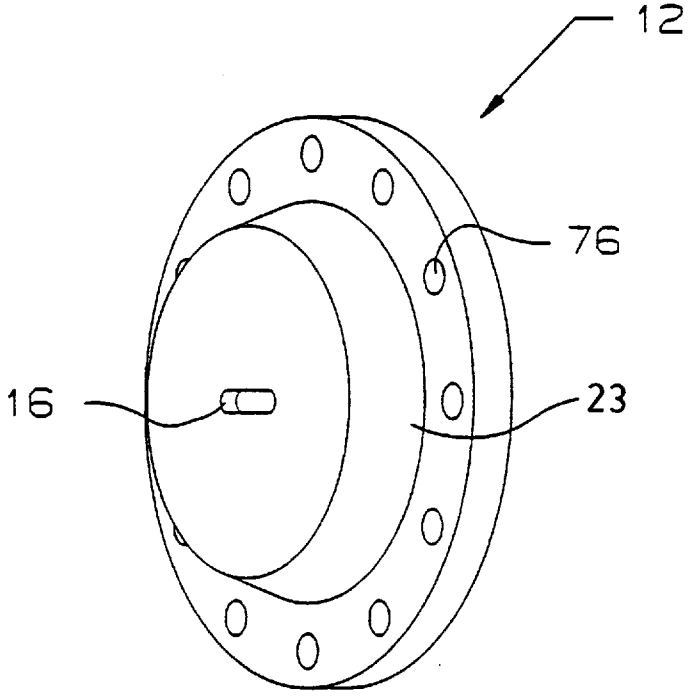
FIG. 6 is a perspective view of an interior of an end cap.
Figure 5:
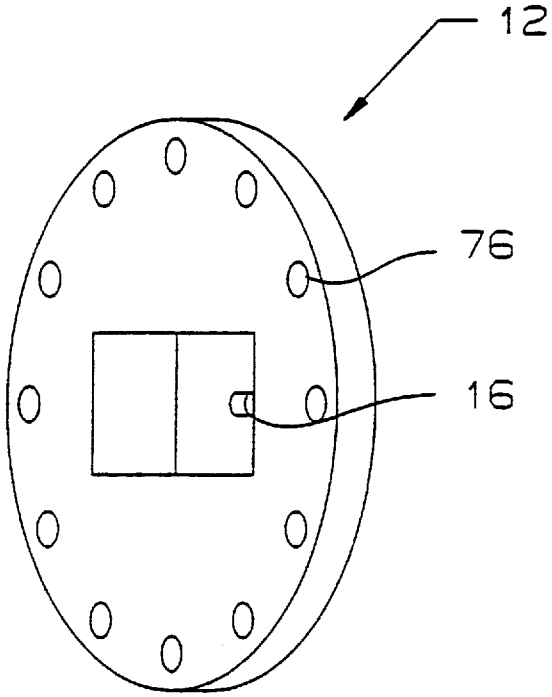
FIG. 5 is a perspective view of an exterior of an end cap.

In FIGS. 5 and 6, there is shown a bottom and a top perspective view of an end cap 12 having an aperture 16 and projection 23. Openings 76 around the periphery are located to receive bolts 20 (not shown in FIGS. 5 and 6).

Figure 8:
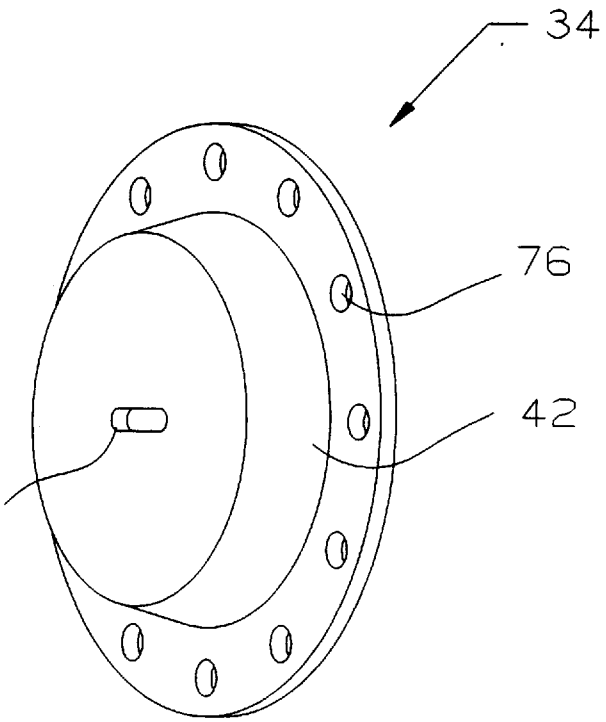
FIG. 8 is a perspective view of an opposite side of the iris of FIG. 7.
Figure 7:
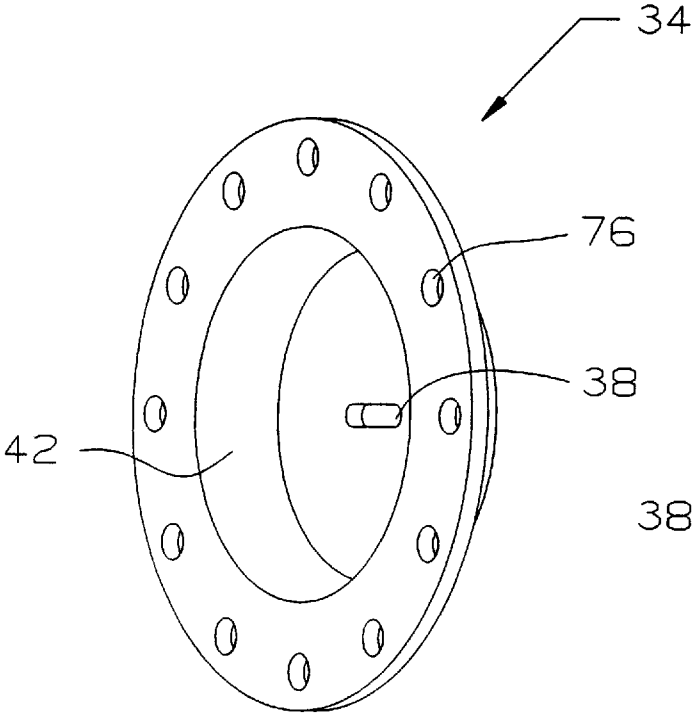
FIG. 7 is a perspective view of one side of an iris.

Similarly, FIGS. 7 and 8 show a bottom and top perspective view respectively of an iris 34 having an aperture 38 and projection 42 with openings 76.

Figure 9:
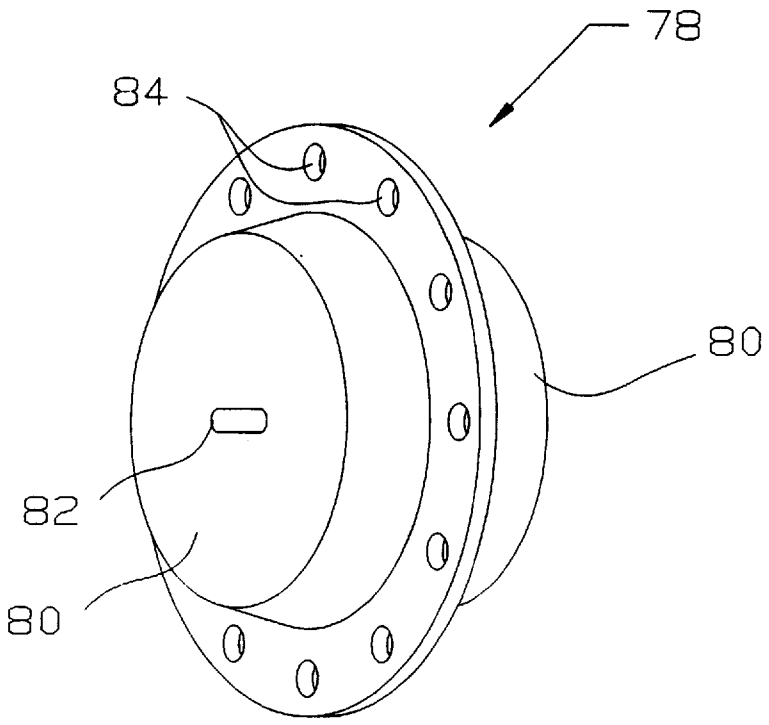
FIG. 9 is a perspective view of an iris having a symmetrical cross-section with two projections.

In FIG. 9, there is shown a symmetrical iris 78 having two projections 80 and an aperture 82. Openings 84 are located to receive bolts (not shown in FIG. 9) to hold the iris 78 in a filter.

Figure 10:
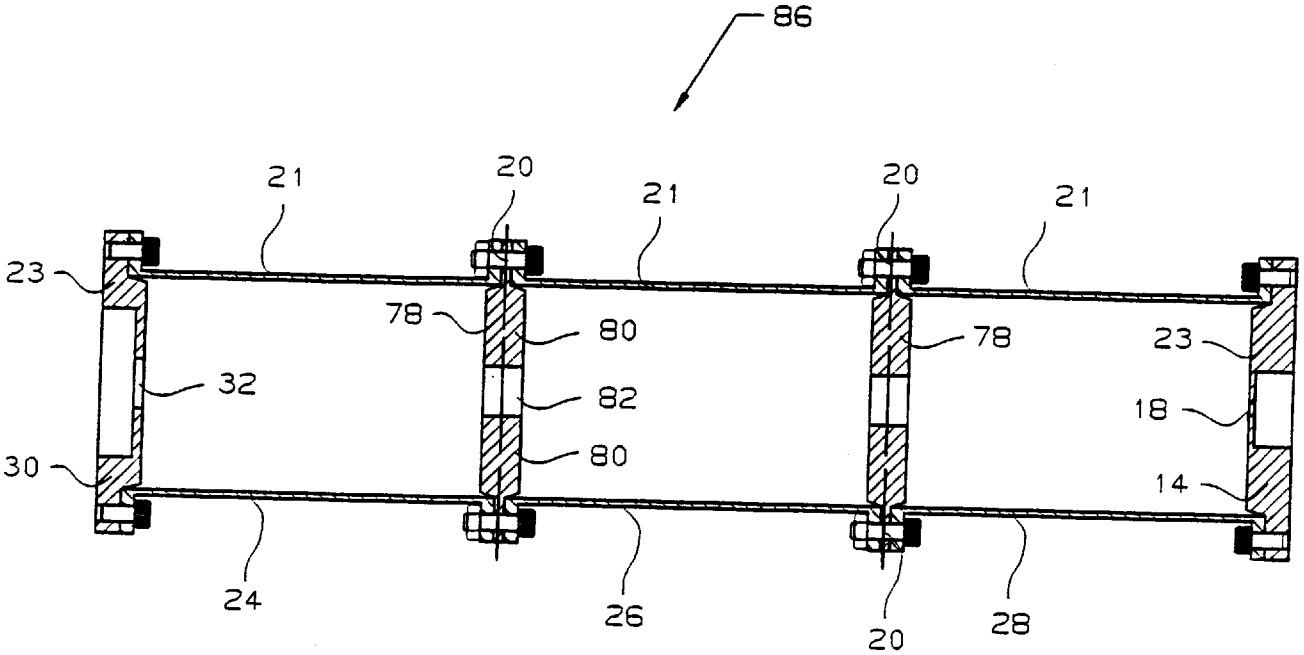
FIG. 10 is a sectional side view of a three-cavity filter containing two symmetrical irises.

In FIG. 10, a three-cavity filter 86 claims two symmetrical irises 78. The same reference numerals are used for the remaining components of the filter 86 as have been used for the filter 22 shown in FIG. 2 as the components are identical.

The end walls of each cavity can be two end caps or one end cap and one iris or two irises depending on whether the filter is a single cavity or a multi-cavity filter and depending on whether the cavity is an end cavity or an interior cavity of a multi-cavity filter.

The waveguide cavities of the filters of the present application preferably have a circular cross-section, but can also have a rectangular or square cross-section.

While the operation of the filters of the present application have been described in relation to an increase in temperature, the opposite effect occurs as temperature decreases. In other words, the resonant frequency increases as temperature decreases and the volume of the cavity decreases. The coefficients of thermal expansion are said to be more positive or less positive for one material or another as coefficients of thermal expansion can be negative. Various materials will be suitable for the cavity walls, end caps and irises. Also, the end caps and irises can be made of different materials. Further, the end caps can have different materials from one another, as can the irises. Each cavity can be designed so that there is one end wall of that cavity that is a temperature compensating end wall for that cavity. Further, each end wall can be designed so that all or nearly all of the cavities has two temperature compensating end walls that compensate for temperature changes for that cavity. Sometimes, it might be desirable to overcompensate for temperature changes so that the volume decrease in a particular cavity from the end walls is greater than a volume increase with temperature for that same cavity from an increase in size of the side wall. While the singular term side wall has been used in this application, where the cavity has a rectangular cross-section, each cavity would have four side walls. The phrase side wall is intended to refer to both a single side wall and multiple side walls of the same cavity. Preferably, the cavity walls are silver plated INVAR (a trademark) and the irises and end caps are silver plated aluminum. Aluminum has a much higher coefficient of thermal expansion than INVAR (a trademark). Numerous other materials will be suitable. For example, graphite, INVAR (a trademark), aluminum, titanium, steel, brass, magnesium, Kevlar (a trademark), polymer composites and graphite fiber composite.

While one material is used to make up each end cap or iris, it is not necessary that the same material be used for all of the end cap and iris components. For example, while all of the end caps and irises will preferably be made from a material having a more positive coefficient of thermal expansion than a coefficient of thermal expansion of a material of said side wall, one end cap can be made from a material having a more positive coefficient of thermal expansion than a material of another end cap. Numerous variations, within the scope of the attached claims, will be readily apparent to those skilled in the art. For example, the filters can be single, dual or triple mode and the cavities can have a circular, elliptical or square cross-section. Further, a filter can be constructed having any combination of single, dual or triple mode cavities. The cavities can resonate in a dominant $TE_{111}$ or $TE_{101}$ mode. However, other modes, for example, $TE_{11n}$ or $TE_{10n}$ can be used (where n is an integer greater than two). When a triple mode cavity is utilized, the modes can be selected from the group of $TE_{11n}$, $TE_{10n}$ or $TM_{01m}$, where n is a positive integer and m is a positive integer or equal to zero.

The present invention can be carried out at relatively low cost compared to other temperature compensation features. In addition, the amount of compensation can be easily calculated and is stable over a relatively wide temperature range. The interfacing waveguide can be recessed into the end cap/iris to allow the end cap/iris to be relatively thin, thereby allowing a wide range of couplings to be achieved.

I claim:

1. A microwave filter comprising at least one cavity resonating at its resonant frequency in at least one mode, said filter having a side wall and two end walls, said two end walls being made of a material having a more positive coefficient of thermal expansion than a coefficient of thermal expansion of a material of said side wall, said two end walls being shaped to project into said at least one cavity to reduce a change in volume of said at least one cavity that would otherwise occur with temperature from a change in size of said side wall, said two end walls each being made from one material, said filter having an input and an output operatively connected thereto.

2. A filter as claimed in claim 1 wherein said end walls are end caps having a U-shaped central portion that comprises a projection extending into said cavity, said projection extending further into said cavity as temperature increases.

3. A filter as claimed in claim 1 wherein said filter has two cavities resonating at the resonant frequency of said filter, said two cavities sharing a second end wall that divides said two cavities said second end wall being an iris.

4. A filter as claimed in claim 1 wherein said filter has three cavities resonating at the resonant frequency of said filter, said three cavities being two end cavities and one interior cavity, said two end cavities each having a second end wall that is shared with said interior cavity, said interior cavity having two second end walls, said second end walls being irises and being shaped to reduce a change in volume in said interior cavity that would otherwise occur with temperature from a change in size of said side wall of said interior cavity, said second end walls each being made of one material.

5. A filter as claimed in claim 1 wherein said filter has four cavities resonating at the resonant frequency of said filter, there being two end cavities and two interior cavities, each of said end cavities having a second end wall that is shared with one of the interior cavities, said interior cavities sharing a third end wall that divides said two interior cavities, said third end wall being an iris, said second end walls being irises and having a higher coefficient of thermal expansion than a coefficient of thermal expansion of material of said side walls, said second end walls being shaped to reduce a change in volume in said interior cavities that would otherwise occur with temperature from a change in size of said side walls of said interior cavities, said second end walls each being made of one material.

6. A filter as claimed in claim 1 wherein the filter has five cavities resonating at the resonant frequency of said filter, there being two end cavities and three interior cavities, said three interior cavities comprising a center cavity and two adjacent cavities, each adjacent cavity being located between said center cavity and one of the end cavities, each end cavity having a second end wall that is shared with one of the adjacent cavities, said adjacent cavities each having a second end wall that divides one adjacent cavity from one end cavity, each adjacent cavity having a third end wall that divides each of the adjacent cavities from the center cavity, said second and third end walls being irises, said second end walls having a more positive coefficient of thermal expansion than a coefficient of thermal expansion of material of said side walls, said second end walls being shaped to reduce a change in volume of each of said adjacent cavities that would otherwise occur with temperature from a change in size of said side walls of said adjacent cavities, said second end walls each being made of one material, said third end walls having a more positive coefficient of thermal expansion than a coefficient of thermal expansion of material of said side walls, said third end walls being shaped to reduce a change in volume in said center cavity that would otherwise occur with temperature from a change in size of said side wall of said center cavity, said third end walls each being made of one material.

7. A filter as claimed in any one of claims 3 or 4 wherein the end walls, that are shaped to reduce a change in volume have a U-shaped central portion that comprises a projection extending into a cavity to reduce a change in volume in that cavity that would otherwise occur with temperature from a change in size of said side wall.

8. A filter as claimed in any one of claims 5 or 6 wherein the end walls, that are shaped to reduce a chance in volume have a U-shaped central portion that comprises a projection extending into a cavity to reduce a change in volume in that cavity that would otherwise occur with temperature from a change in size of said side wall.

9. A filter as claimed in any one of claims 3, 4 or 5 wherein at least one iris that is shaped to reduce a change in volume has a symmetrical cross-section normal to a longitudinal axis of the filter, said iris having two projections with one projection extending into one cavity and another projection extending into another cavity.

10. A filter as claimed in any one of claims 4 or 5 wherein the irises that are shaped to reduce a change in volume have a symmetrical cross-section normal to a longitudinal axis of the filter, each of said irises having two projections with one projection extending into one cavity and another projection extending into another cavity.

11. A filter as claimed in any one of claims 1, 4 or 5 wherein said at least one mode is selected from the group of $TE_{11n}$ and $TE_{10n}$, where n is a positive integer.

12. A filter as claimed in any one of claims 1, 4 or 5 wherein the filter is a dual mode filter wherein said at least one cavity resonates in at least two modes and said modes are selected from the group of $TE_{11n}$ and $TE_{10n}$, where n is a positive integer greater than one.

13. A filter as claimed in any one of claims 1, 4 or 5 wherein the filter is a triple mode filter having at least one cavity resonating in a triple mode wherein said modes are selected from the group of $TE_{11n}$, $TE_{10n}$ and $TM_{01m}$, where n is a positive integer and m is a positive integer equal to or greater than zero.

14. A filter as claimed in any one of claims 1, 4 or 5 wherein the material for the side wall and the material for the end walls, being different from one another, are selected from the group of aluminum, INVAR (a trademark), silver plated aluminum, silver plated Invar, graphite, titanium, steel, brass, magnesium, Kevlar, polymer composites and graphite fiber composite.

15. A filter as claimed in claim 1 wherein said filter has at least three cavities and each cavity contains at least one end wall made from a material having a coefficient of thermal expansion that is more positive than a coefficient of thermal expansion than a material for said side wall.

16. A filter as claimed in claim 1 wherein said filter has at least four cavities and each cavity contains at least one end wall made from a material having a coefficient of thermal expansion that is more positive than a coefficient of thermal expansion than a material for said side wall.

17. A filter as claimed in claim 1 wherein said filter has at least five cavities and each cavity contains at least one end wall made from a material having a coefficient of thermal expansion that is more positive than a coefficient of thermal expansion than a material for said side wall.

* * * * *